US008858412B2

(12) United States Patent
Jeong et al.

(10) Patent No.: US 8,858,412 B2
(45) Date of Patent: Oct. 14, 2014

(54) PICKUP ROLLER AND IMAGE FORMING APPARATUS HAVING THE SAME

(75) Inventors: Jae-hyeuk Jeong, Suwon-si (KR); Cheong-jin Jang, Seoul (KR); Min-chan Kim, Seoul (KR); Ae-kyung Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 632 days.

(21) Appl. No.: 12/826,931

(22) Filed: Jun. 30, 2010

(65) Prior Publication Data

US 2011/0158726 A1 Jun. 30, 2011

(30) Foreign Application Priority Data

Dec. 24, 2009 (KR) ..... 10-2009-0131208

(51) Int. Cl.
*B65H 3/06* (2006.01)
*G03G 15/00* (2006.01)

(52) U.S. Cl.
CPC ..... *G03G 15/6511* (2013.01)
USPC ..... 492/49; 492/25; 492/53; 492/56

(58) Field of Classification Search
USPC ..... 492/22, 24, 25, 26, 49, 53, 54, 56
See application file for complete search history.

(56) References Cited

U.S. PATENT DOCUMENTS 6,004,669 A * 12/1999 Rokutan et al. ..... 428/335
7,448,610 B2 * 11/2008 Ito et al. ..... 271/109

FOREIGN PATENT DOCUMENTS

| | | |
|---|---|---|
| EP | 1178365 | 2/2002 |
| EP | 1226956 | 7/2002 |
| JP | 2001-341862 | 12/2001 |
| WO | 00/44655 | 8/2000 |

OTHER PUBLICATIONS

European Search Report dated Aug. 20, 2014 issued in EP Application No. 10170677.8.

* cited by examiner

*Primary Examiner* — Christopher Besler
(74) *Attorney, Agent, or Firm* — Stanzione & Kim, LLP

(57) ABSTRACT

A pickup roller includes a supporting layer and a pickup layer, which includes a base surrounding the outer perimeter of the supporting layer and a plurality of particles which are distributed throughout the base and have a different hardness than a hardness of the base.

19 Claims, 3 Drawing Sheets

PICKUP ROLLER AND IMAGE FORMING APPARATUS HAVING THE SAME

CROSS-REFERENCE TO RELATED APPLICATIONS

This application claims the benefit of priority under 35 U.S.C. §119 to Korean Patent Application No. 10-2009-0131208, filed on Dec. 24, 2009, in the Korean Intellectual Property Office, the disclosure of which is incorporated herein in its entirety by reference.

BACKGROUND

1. Field of the Invention

The present general inventive concept relates to a pickup roller and an image forming apparatus having the same.

2. Description of the Related Art

An electrophotographic image forming apparatus develops an image by forming an electrostatic latent image by scanning a light beam over a photosensitive drum by using a light scanner, forming a developed image by developing the electrostatic latent image by using a developing agent (e.g. a toner), transferring the developed image onto a printing medium, and fixing the transferred image to the printing medium.

Such an electrophotographic image forming apparatus includes a pickup roller to pick up a printing medium from a plurality of printing media stacked in a cassette and to transport the picked-up printing medium into the electrophotographic image forming apparatus. It is necessary for such a pickup roller to pick up a printing medium at a constant rate regardless of characteristics of the printing medium and without slipping or damaging the printing medium.

However, as a pickup roller has been used for a certain period of time, it becomes difficult to pick up a printing medium due to abrasion or pollution of the surface of the pickup roller. The problem is significant for a pickup roller employing soft rubber.

When relatively hard rubber is used to resolve the problem, the durability against abrasion of the surface of a pickup roller may be resolved. However, in this case, a printing medium may not be properly transported due to characteristics thereof (e.g. basis weight, thickness, surface characteristics), because it is difficult to achieve sufficient friction between the hard rubber and the printing medium.

Furthermore, when a pressure applied to a printing medium is increased to achieve higher friction between a pickup roller employing hard rubber and the printing medium, the printing medium may be damaged, and the durability of the pickup roller may also deteriorate due to pollution or destruction of the surface of the pickup roller. Therefore, a durable pickup roller, which applies a relatively small amount of pressure to a printing medium and maintains sufficient friction between the pickup roller and the printing medium, is required.

SUMMARY

The present general inventive concept provides a durable pickup roller, which is capable of obtaining sufficient friction from a relatively small amount of pressure, and an image forming apparatus having the same.

Additional aspects and utilities of the present general inventive concept will be set forth in part in the description which follows and, in part, will be obvious from the description, or may be learned by practice of the present general inventive concept.

Features and utilities of the present general inventive concept may be achieved by a pickup roller including a supporting layer and a pickup layer, which includes a base surrounding the outer perimeter of the supporting layer, and a plurality of particles, which are distributed throughout the base and have a different hardness from the base.

Features and/or utilities of the present general inventive concept may also be realized by an image forming apparatus including a pickup roller including a supporting layer and a pickup layer, which includes a base surrounding the outer perimeter of the supporting layer and a plurality of particles, which are distributed throughout the base and have a different hardness from the base, a printing unit which forms an image on a printing medium that is picked up and transported by the pickup roller, a fixing unit which fuses the image formed on the printing medium to the printing medium by applying heat and pressure thereto, and a discharging roller which discharges the printing medium, to which the image is fixed, to a tray.

Features and/or utilities of the present general inventive concept may also be realized by a method of forming a roller including forming a supporting layer around an outer circumference of a shaft, forming a base to surround an outer circumference of the supporting layer, and distributing a plurality of particles throughout the base, the particles having a hardness different from a hardness of the base.

The method may further include forming functional end groups on the surfaces of the particles before distributing the particles throughout the base.

The functional end groups may be formed via plasma processing.

Alternatively, the functional end groups may be formed via surface coating.

The hardness of the particles may be less than the hardness of the base.

The hardness of the particles may be between about HRC 5 and HRC 20.

The hardness of the base may be between about HRC 40 and HRC 60.

The particles may comprise between 5% and 20% by weight of a sum of the particles and base.

The particles may be made of the same material as the base.

The method may further include, before forming the base, forming a pickup supporting layer on an outer circumference of the supporting layer, and the base may surround the outer circumference of the pickup supporting layer.

A hardness of the pickup supporting layer may be less than a hardness of the base.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE EMBODIMENTS

Figure 1:
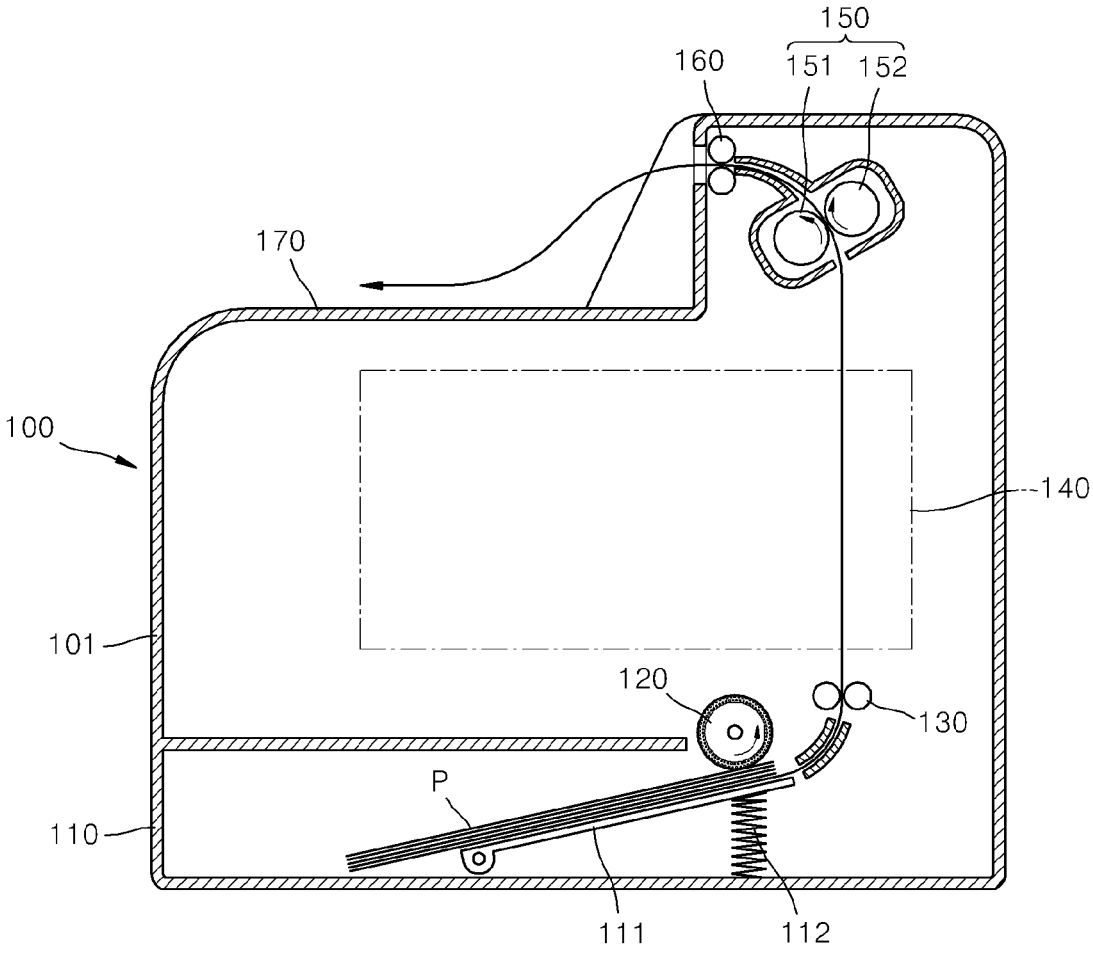
FIG. 1 is a side sectional view of an image forming apparatus having a pickup roller according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
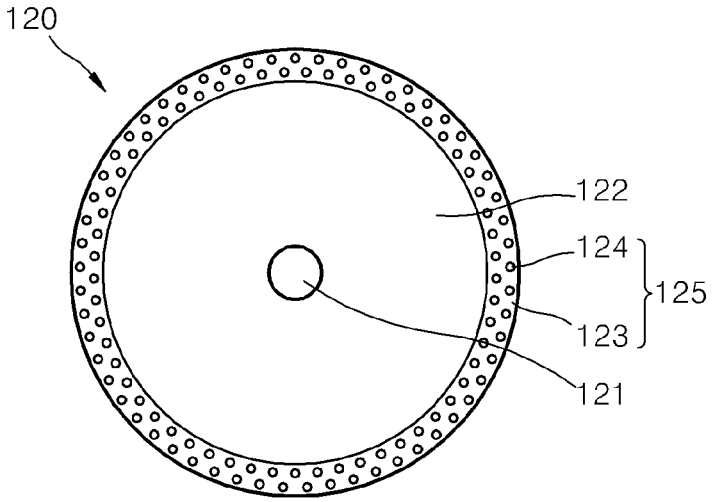
FIG. 2 is a sectional view of the pickup roller shown in FIG. 1.
Figure 3:
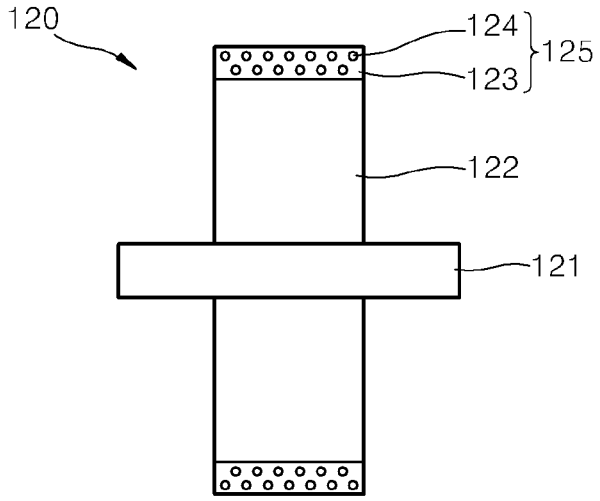
FIG. 3 is a cross-sectional view of the pickup roller shown in FIG. 1.

FIG. 1 is a side sectional view of an image forming apparatus 100 having a pickup roller 120 according to an embodiment of the present general inventive concept. FIG. 2 is a sectional view of the pickup roller 120 shown in FIG. 1, and FIG. 3 is a cross-sectional view of the pickup roller 120 shown in FIG. 1.

Referring to FIG. 1, the image forming apparatus 100 prints an image on a printing medium by performing electrophotographic operations, and a cassette 110, in which a plurality of printing media P are stacked, is removably attached to the lower portion of a body 101 of the image forming apparatus 100.

The cassette 110 is elastically biased upward by a spring 112, and includes a printing medium supporter 111, on which a printing medium P is loaded. The pickup roller 120, which rotates and picks up each of the plurality of printing media P one-by-one, is installed above the cassette 110.

An image is developed on a printing medium P picked up by the roller 120 as the printing medium P is transported through a printing unit 140 by a transporting roller 130. Heat and pressure are applied to the image, which is developed on the printing medium P by the printing unit 140, as the printing medium P passes through a fixing unit 150, and thus the image is fused on the printing medium P. The fixing unit 150 includes a pressing roller 151, which applies pressure, and a heating roller 152, which is in surface contact with the pressing roller 151 and applies heat. The printing medium P to which the image is fixed as the printing medium P passes through the fixing unit 150 is discharged to a tray 170 by a discharging roller 160. The printing unit 140 may form a monochrome image or a color image.

Referring to FIGS. 2 and 3, the pickup roller 120 is supported by a shaft 121, and includes a supporting layer 122 having a predetermined diameter, a base 123 covering the outer perimeter of the supporting layer 122 with a predetermined thickness, and a pickup layer 125 consisting of a plurality of particles 124 that are distributed throughout the base 123. The shaft 121 of the pickup roller 120 is rotatably installed on the body 101, so that the pickup roller 120 rotates to pick up each of the plurality of printing media P one-by-one and transport the picked-up printing media P into the body 101.

The base 123 may be formed of ethylene propylene diene monomer (EPDM), pure or composite IR, or an elastic material with sufficient abrasion resistance and surface friction (e.g. a urethane material).

The plurality of particles 124 are formed of the same material as the base 123, and may be distributed throughout the base 123 as uniform particles having a diameter from about 0.1 μm to about 1 mm. When the plurality of particles 124 are formed of the materials stated above or are processed, the connection between the plurality of particles 124 and the base 123 may be weakened due to surface plastification or destruction of functional end-groups, and thus the plurality of particles 124 may be separated from the base 123 due to friction and abrasion. As a result, the surface of a pickup layer 125 may become uneven or cracked. To prevent the deterioration of the pickup layer 125, the plurality of particles 124 may be distributed throughout the base 123 after forming functional end-groups on the surfaces of the plurality of particles 124 by using a surface modification method, such as plasma processing or surface coating. Here, although the plasma processing may vary according to characteristics of materials for forming the plurality of particles 124, the plasma processing may be performed for surface modification by using a discharging power of about 50 W for from about 10 minutes to about 30 minutes. A functional end-group is given its ordinary meaning to those skilled in the art, which is a group of atoms within a macromolecule, located at an extremity of the macromolecule, that is responsible for the characteristic reactions of the macromolecule.

The hardness of the base 123 may be from about HRC 40 to about HRC 60 (Rockwell scale). The hardness of the plurality of particles 124 is lower than the hardness of the base 123, and may be from about HRC 5 to about HRC 20. The weight of the plurality of particles 124 may be from about 5% to about 20% of the weight of the entire pickup layer 125.

Figure 4:
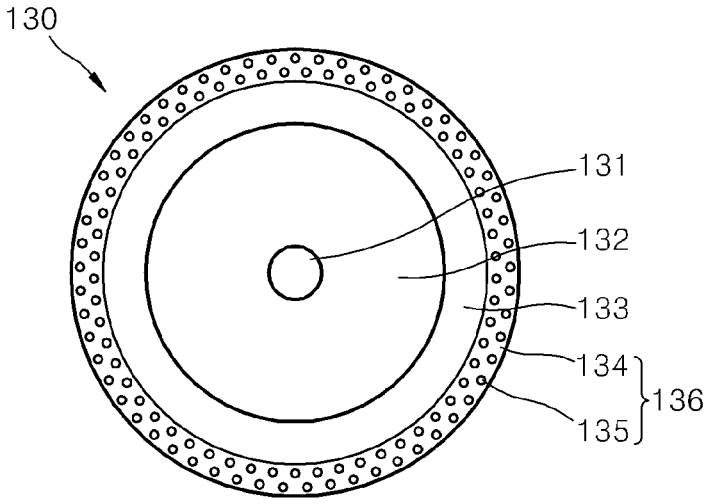
FIG. 4 is a sectional view of a pickup roller according to another embodiment of the present general inventive concept.

FIG. 4 is a sectional view of a pickup roller 130 according to another embodiment of the present general inventive concept.

Basically, the configuration of the pickup roller 130 shown in FIG. 4 is identical to that of the pickup roller 120 shown in FIG. 2, except that the pickup roller 130 further includes a pickup supporting layer between a supporting layer and a pickup layer.

Referring to FIG. 4, the pickup roller 130 is supported by a shaft 131, and includes a supporting layer 132 having a predetermined diameter, a pickup supporting layer 133 covering the outer perimeter of the supporting layer 132 with a predetermined thickness, a base 134 covering the outer perimeter of the pickup supporting layer 133 with a predetermined thickness, and a pickup layer 136 consisting of a plurality of particles 135 that are distributed throughout the base 134.

The base 134 may be formed of ethylene propylene diene monomer (EPDM), pure or composite IR, or an elastic material with sufficient abrasion resistance and surface friction (e.g. an urethane material).

The plurality of particles 135 are formed of the same material as the base 134, and may be distributed throughout the base 134 as uniform particles having a diameter from about 0.1 μm to about 1 mm. When the plurality of particles 135 are formed of the materials stated above or are processed, the connection between the plurality of particles 135 and the base 134 may be weakened due to surface plastification or destruction of functional end-groups, and thus the plurality of particles 135 may be separated from the base 134 due to friction and abrasion. As a result, the surface of a pickup layer 136 may become uneven or cracked. To prevent the deterioration of the pickup layer 136, the plurality of particles 135 may be distributed throughout the base 134 after forming functional end-groups on the surfaces of the plurality of particles 135 by using a surface modification method, such as plasma processing or surface coating. Here, although the plasma processing may vary according to characteristics of materials for forming the plurality of particles 135, the plasma process may be performed for surface modification by using a discharging power of about 50 W for from about 10 minutes to about 30 minutes.

The hardness of the base 134 may be from about HRC 40 to about HRC 60 (Rockwell scale). The hardness of the plurality of particles 135 is lower than the hardness of the base 134, and may be from about HRC 5 to about HRC 20. The weight of the plurality of particles 135 may be from about 5% to about 20% of the weight of the entire pickup layer 136.

The pickup supporting layer 133 may be easily deformed at a low pressure, and thus the pickup supporting layer 133 may provide a sufficient contact area to a portion of the pickup layer 136 contacting a printing medium. Furthermore, the pickup supporting layer 133 may reduce errors, such as skew or incomplete transportation of a printing medium due to partial abrasion or partial pollution of the pickup roller 130, by maintaining a uniform pressure on a printing medium according to characteristics of the printing medium and inducing uniform distribution of pressure applied by the portion of the pickup layer 136 contacting a printing medium. Furthermore, deterioration of the functionality of the pickup layer 136 due to repeated usage thereof may be prevented by inducing balanced abrasion of the pickup layer 136. Therefore, the pickup supporting layer 133 may be formed of a material that may be easily compressed and deformed; e.g. porous foam, rubber with low hardness, or a pad. The pickup supporting layer 133 is formed of a material having a hardness lower than that of the base 134.

Figure 5:
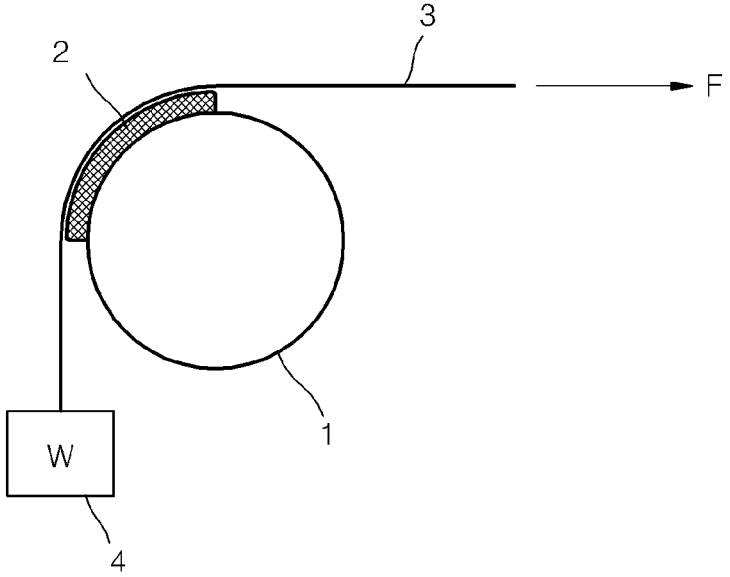
FIG. 5 is a diagram of an experiment device for testing the hardness of a pickup roller according to an embodiment of the present general inventive concept.

FIG. 5 is a diagram of an experiment device for testing hardness of a pickup roller, according to an embodiment of the present general inventive concept.

Referring to FIG. 5, a pickup pad 2, which is identical to the pickup layer 125 shown in FIG. 2 or the pickup layer 136 shown in FIG. 4, is provided on a fixing jig 1, and then a printing medium 3, which has a dimension of 10 mm*200 mm, is provided on the pickup pad 2. Next, a weight 4 of weighs 19.5 g, is attached to an end of the printing medium 3, and friction between the printing medium 3 and the pickup pad 2 is measured as a pulling force F on the other end of the printing medium 3, which is the end opposite to the end to which the weight 4 is attached, causing the printing medium 3 to move at a speed of 2 mm/s. Results of experiments are shown in Table 1 below.

TABLE 1

| | | Coefficients of Friction | | |
|---|---|---|---|---|
| Base | Particles | Hansol (75 g/m$^2$) | Xerox (90 g/m$^2$) | Xerox (Transparent) |
| EPDM | 0 | 1.88 | 1.67 | 2.16 |
| | 10 | 2.95 | 2.75 | 3.05 |
| | 15 | 3.05 | 2.96 | 3.15 |
| EPDM/IR (80/20) | 0 | 1.77 | 1.63 | 2.03 |
| | 10 | 2.87 | 2.54 | 2.98 |
| | 15 | 3.01 | 2.75 | 3.12 |
| EPDM/IR (30/70) | 0 | 2.05 | 1.79 | 2.25 |
| | 10 | 3.05 | 2.68 | 3.15 |
| | 15 | 3.21 | 2.98 | 3.32 |

Here, a pickup unit is formed of either EPDM, which has a sample hardness of HRC 40, (Kumho Co., Ltd.), or is formed to have the overall sample hardness of HRC 30±5 by combining a base, which is formed by mixing EPDM, which has a sample hardness of HRC 40, (Kumho Co., Ltd.), and IR, which has a sample hardness of HRC 40, (Zeon Co., Ltd.) at a predetermined ratio, and particles, which have a sample hardness of HRC 20, (Kumho Co., Ltd.).

In the column "Base" in Table 1, EPDM/IR (80/20) indicates that EPDM and IR are mixed at a 80%/20% ratio. In the column "Coefficients of Friction," "Hansol" and "Xerox" are names of manufacturers of printing media, and numbers in brackets indicate overall weight of a printing medium per square meter. Therefore, "Hansol (75 g/m$^2$)" indicates a printing medium manufactured by Hansol Co., Ltd., where the overall weight per unit square meter is 75 g, and "Xerox (Transparent)" indicates a transparent printing medium manufactured by Xerox Co., Ltd.

A coefficient of friction is calculated as shown below.

$$\text{Coefficient of Friction}=(2/3.141592)*\ln(\text{friction force}/19.5\text{ gf}) \quad \text{<Equation 1>}$$

Referring to Table 1 and Equation 1, the coefficient of friction is greater due to increased friction in the case where there are particles with low hardness. When the particle content is 15%, the coefficient of friction is greatest. This result appears to be based on an increase in friction due to firm contact between a pickup unit and a printing medium, rather than an increase in the area of contact between the pickup unit and the printing medium.

Next, results of an implementation test for investigating a relationship between abrasion resistance of a pickup layer and particle contents are shown in Table 2 below.

During testing, performance of a pickup layer after a pickup roller, in which a semi-circular pickup pad (width×thickness×circumference=26 mm×2 mm×60 mm) wraps a supporting layer (122 of FIG. 2 or 131 of FIG. 4), has picked up 100,000 printing media at a rate of 20 pages per minute (PPM), and partial abrasion, surface pollution, and surface unevenness of the pickup layer are evaluated.

Here, the performance of the pickup layer is evaluated by evaluating a pickup failure or a transportation failure while 500 of each of three types of printing media (printing media shown in Table 1) are being printed after the implementation test. The partial abrasion, the surface pollution, and the surface unevenness of the pickup layer are determined with reference to a case in which the pickup layer is formed of EPDM.

TABLE 2

| | | | Problems | | |
|---|---|---|---|---|---|
| Base | Particles | Performance | Partial Abrasion | Surface Pollution | Surface Unevenness |
| EPDM | 0 | X | X | X | X |
| | 10 | ○ | ○ | Δ | ○ |
| | 15 | Δ | ◎ | Δ | Δ |
| | 25 | X | ○ | X | X |
| EPDM/IR (80/20) | 0 | Δ | X | X | X |
| | 10 | ◎ | ○ | Δ | ◎ |
| | 15 | ○ | ◎ | Δ | ○ |
| | 25 | Δ | Δ | X | Δ |
| EPDM/IR (30/70) | 0 | Δ | X | X | X |
| | 10 | ◎ | ○ | Δ | ◎ |
| | 15 | ○ | ◎ | Δ | ◎ |
| | 25 | Δ | Δ | Δ | X |

(X-unsatisfactory, Δ-intermediate, ○-satisfactory, ◎-highly satisfactory)

Referring to Table 2, particle content may be from about 10% to about 15% for optimal results with respect to partial abrasion, surface pollution, and surface unevenness.

In the case where particle content is less than 10%, surface adhesiveness with respect to a printing medium is reduced, and the surface of a pickup layer is cracked due to stresses concentrated by a friction force generated by a particular portion of a pickup layer. Therefore, performance of a pickup layer deteriorates, and the pickup layer exhibits problems such as surface unevenness, surface pollution, and partial abrasion.

In the case where particle content is equal to or greater than 25%, it is determined that durability of a pickup layer deteriorates due to not only uneven distribution, but also due to abrasion of the surface due to friction. In other words, the surface of the pickup layer becomes uneven due to abrasion of a portion with relatively low mechanical durability, and performance of the pickup layer deteriorates as pollution and abrasion increase. However, in this case, deterioration of performance of the pickup layer is not as significant as deterioration of performance of a pickup layer in the case in which there are no particles (particle content is 0%). Therefore, it is more preferable for a pickup layer to contain particles.

Results of evaluating the performance of a pickup supporting layer are shown in Table 3 below. The performance evaluation is performed with respect to EPDM/IR (80/20)+10% and EPDM/IR (30/70)+10% corresponding to the optimal results in Tables 1 and 2. Here, the pickup supporting layer is a foam pad with a thickness of about 1 mm, and is adhered to a supporting layer and a pickup layer via primer processing.

TABLE 3

| | | Problems | | |
|---|---|---|---|---|
| Base + Particle | Performance | Partial Abrasion | Surface Pollution | Surface Unevenness |
| EPDM + 10% | ○ | ◎ | ○ | ○ |
| EPDM/IR (80/20) + 10% | ◎ | ◎ | ○ | ◎ |
| EPDM/IR (30/70) + 10% | ◎ | ◎ | ○ | ◎ |

(Δ-intermediate, ○-satisfactory, ◎-highly satisfactory)

Referring to Table 3 and Table 2, performance of a pickup roller does not deteriorate due to vertical pressure, and resistance thereof is improved. Furthermore, since a pickup supporting layer absorbs unnecessary pressure, resistance of a pickup layer is improved.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims. For example, while the present general inventive concept has been described with reference to a pickup roller, the concept may be applied to any type of roller to improve pickup properties.

What is claimed is:

1. A pickup roller comprising:
a supporting layer; and
a pickup layer, which comprises:
a base surrounding the outer perimeter of the supporting layer, the base being formed of one or more elastic materials; and
a plurality of particles being formed of at least one of the one or more elastic materials, the plurality of particles being distributed throughout the base and have a hardness different from a hardness of the base, and functional end-groups being formed on surfaces of the plurality of particles.

2. The pickup roller of claim 1, wherein the hardness of the plurality of particles is lower than the hardness of the base and is in a range of about HRC 5 to about HRC 20.

3. The pickup roller of claim 1, wherein the plurality of particles are evenly distributed throughout the base by modifying surfaces thereof via plasma processing.

4. The pickup roller of claim 1, wherein the plurality of particles are evenly distributed throughout the base by modifying surfaces thereof via surface coating.

5. The pickup roller of claim 1, wherein the weight of the plurality of particles is be from about 5% to about 20% of the weight of the entire pickup layer.

6. The pickup roller of claim 1, wherein the diameter of each of the plurality of particles is from about 0.1 μm to about 1 mm.

7. The pickup roller of claim 1, wherein the hardness of the base is from about HRC 40 to about HRC 60.

8. The pickup roller of claim 1, further comprising a pickup supporting layer which is interposed between the supporting layer and the pickup layer and which has a hardness lower than the hardness of the base.

9. The pickup roller of claim 8, wherein the pickup supporting layer is formed of a porous material.

10. An image forming apparatus comprising:
a pickup roller;
a printing unit which forms an image on a printing medium that is picked up and transported by the pickup roller;
a fixing unit which fuses the image formed on the printing medium to the printing medium by applying heat and pressure thereto; and
a discharging roller which discharges the printing medium, to which the image is fixed, to a tray,
wherein the pickup roller comprises:
a supporting layer; and
a pickup layer, which comprises:
a base surrounding the outer perimeter of the supporting layer, the base being formed of one or more elastic materials; and
a plurality of particles being formed of at least one of the one or more elastic materials, the plurality of particles being distributed throughout the base and have a hardness different from a hardness of the base, and functional end-groups being formed on surfaces of the plurality of particles.

11. The image forming apparatus of claim 10, wherein the hardness of the plurality of particles is lower than the hardness of the base and is in a range of about HRC 5 to about HRC 20.

12. The image forming apparatus of claim 10, wherein the plurality of particles are evenly distributed throughout the base by modifying surfaces thereof via plasma processing.

13. The image forming apparatus of claim 10, wherein the plurality of particles are evenly distributed throughout the base by modifying surfaces thereof via surface coating.

14. The image forming apparatus of claim 10, wherein the weight of the plurality of particles is from about 5% to about 20% of the weight of the entire pickup layer.

15. The image forming apparatus of claim 10, wherein the diameter of each of the plurality of particles is from about 0.1 μm to about 1 mm.

16. The image forming apparatus of claim 10, wherein the base and the plurality of particles are formed of the same material.

17. The image forming apparatus of claim 10, wherein the hardness of the base is from about HRC 40 to about HRC 60.

18. The image forming apparatus of claim 10, further comprising a pickup supporting layer which is interposed between the supporting layer and the pickup layer and which has a hardness lower than the hardness of the base.

19. The image forming apparatus of claim 18, wherein the pickup supporting layer is formed of a porous material.

* * * * *

UNITED STATES PATENT AND TRADEMARK OFFICE

CERTIFICATE OF CORRECTION

PATENT NO. : 8,858,412 B2
APPLICATION NO. : 12/826931
DATED : October 14, 2014
INVENTOR(S) : Jae-hyeuk Jeong et al.

It is certified that error appears in the above-identified patent and that said Letters Patent is hereby corrected as shown below:

In the Claims

Column 8, line 2, in claim 5 delete "particles is be from" and insert -- particles is from --, therefore Signed and Sealed this
Nineteenth Day of May, 2015

Michelle K. Lee

Michelle K. Lee
*Director of the United States Patent and Trademark Office*